US006120226A

United States Patent [19]

Egger et al.

[11] Patent Number: 6,120,226

[45] Date of Patent: Sep. 19, 2000

[54] RAILING FASTENER FOR DRAWER

[75] Inventors: Remo Egger, Bregenz; Adolf Scheible, Lauterach, both of Austria

[73] Assignee: Grass GmbH, Voralberg, Austria

[21] Appl. No.: 09/349,589

[22] Filed: Jul. 9, 1999

[51] Int. Cl.[7] ..... F16B 13/06; A47B 95/02

[52] U.S. Cl. ..... 411/48; 411/57.1; 411/73; 312/348.6

[58] Field of Search ..... 411/44, 45, 46, 411/48, 57.1, 62, 72, 73; 312/348.6

[56] References Cited

U.S. PATENT DOCUMENTS

| | | | |
|---|---|---|---|
| 5,568,675 | 10/1996 | Asami et al. | 411/48 X |
| 5,586,364 | 12/1996 | Ferrari et al. | 411/46 X |
| 5,632,581 | 5/1997 | Hasada | 411/48 |
| 5,641,255 | 6/1997 | Tanaka | 411/48 |

*Primary Examiner*—Neill Wilson
*Attorney, Agent, or Firm*—Kilpatrick Stockton LLP

[57] ABSTRACT

The invention pertains to a railing fastener for drawers that has one part with an expansion dowel located in the front panel of the drawer and one part that is a fastener (that can be inserted), which is connected in the dowel to the railing pipe. The fastener fitting has a head component with an expansion head that can be inserted in the expansion dowel. Guides and/or catches are provided on the head component, respectively the expansion head, that work together with the corresponding grooves or catch openings of the expansion dowel. After completely inserting the expansion head, the expansion dowel spreads, activated by the swinging or swiveling of the fastener fitting; the guides or catches reach the corresponding lock-in positions so that the fastener fitting is held securely in the expansion dowel and an extraction of the expansion head is no longer possible.

16 Claims, 10 Drawing Sheets

RAILING FASTENER FOR DRAWER

BACKGROUND OF THE INVENTION

This invention pertains to a railing fastener for a drawer according to the characterizing concepts of the independent patent claims.

A simple type of the railing fastener is made known by the registered patent DE 29507322. This fastener consists of a bracing (7), which is anchored in the drawer's front panel. Furthermore, an adjustment component, which is fastened to the railing pipe, is provided. The adjustment component, which can be inserted into the bracing, allows a longitudinal adjustment of the railing.

A further development is made known by the registered patent DE 295 18 690. Here an expansion dowel, anchored in the cabinet/furniture fitting by means of a suitable expansion component, is located in the drawer's front panel. By inserting the expansion component and tilting the whole fastening system, the expansion component is moved axially in the expansion dowel so that the dowel expands and anchors firmly in the front panel.

The U.S. Pat. No. 5,690,450 makes known a fastening system for fastening a railing with a drawer back wall so that the railing's end is connected with a fastening component. A corresponding fastening component in the drawer back wall has an open slot aperture in which the fastening component can be hanged. Furthermore, the fastening component has a catch hook, which engages behind an edge of the backside of the component and, thus, secures the connection.

The object of the present invention is based on the task of further developing and improving a drawer's railing fastener with regard to the ease of assembly, space required and the fastener's assembly and load capacity.

SUMMARY OF THE INVENTION

The present task is solved by the identifying characteristics of the independent patent claims.

A first embodiment of the invention distinguishes itself by the head component with an expansion head, which can be inserted in the expansion dowel. The expansion head has guiding ribs, which guide the expansion head into the corresponding expansion dowel's guiding grooves. After the expansion head is fully inserted, swiveling or swinging the head component causes the expansion or spreading of the expansion dowel so that the guiding ribs disengage with the guiding grooves and the expansion head is securely fixed (from being pulled out).

Another development of this embodiment shows the expansion head with a lever piece that, when tilted, has a counter-pressure-acting shoulder, which engages in a corresponding notch of the expansion dowel.

The expansion dowel has an elongated opening to guide the insertion of the expansion head; the guiding grooves are located within a sub-section of the expansion dowel's elongated opening. The guiding grooves don't extend over the entire length of the expansion dowel so that, after the head component has been inserted, it can be swiveled.

Furthermore, it is provided that in the expansion dowel there is an edge, which is axially directed towards the insertion opening. This edge, which lies on a shoulder of the inserted expansion head, provides additional protection against axial extraction.

Preferably, the head component has a coupling in which a corresponding counterpart of an intermediate piece can be hanged. A railing pipe is fastened to the intermediate pipe.

A second embodiment of the invention distinguishes itself by the fastener fitting that has a head component with an expansion head, which can be inserted into the expansion dowel. The expansion head has at least one catch shoulder at its rear end that, after a complete insertion of the expansion head in the expansion dowel, reaches with its catch shoulders in the expansion dowel's catch notches in the respective first lock-in position. By swinging the expansion head, the expansion dowel spreads and the catch shoulders go into the respective expansion dowel's catch notches, bringing about the second lock-in position. This secures the expansion head from extraction, preventing it from being pulled out.

Another axial securing of the expansion head is reached by at least one outwardly directed anchoring projection that is located radial on the expansion head.

In order to make the swinging or swiveling of the head component easier, the head component has two opposite-located radial outwardly directed bearing shoulders, which engage, after the complete insertion of the head component in the corresponding bearing notch, along an axis defined by the bearing shoulders.

The spreading of the expansion dowel is not caused by the head component, but by an expansion wedge in front of the head component. The expansion dowel has a somewhat V-shaped elongated opening that fits across the expansion wedge so that when the head component swivels, the expansion component moves across to the elongated opening and presses on the inner surface of the expansion dowel so that it spreads or expands outwardly.

A third embodiment of the invention shows a fastening component that has a hook extension that can be hanged in the corresponding opening of the drawer's back wall, which has an opposite-acting detent pawl on the hook extension, which keeps the hook extension from unhooking and so prevents the fastening component of the back wall from coming undone.

The detent pawl is, preferably, formed as a springy tab, whose locking action can be lifted up manually or with an appropriate tool. The detent pawl supports itself with it at the inside edge of the engagement opening.

Preferably, the railing pipe can be inserted in a corresponding opening of the fastening component and can be locked there by the railing pipe that has a tab on its outer perimeter, whose free end points in the direction of the railing pipe end. A catch shoulder, which presses the tabs radial and inward with the insertion of the railing pipe, causes the railing pipe to catch within the opening.

An essential advantage of the invention is the tool-free quick assembly of the railing fastener, as well as of the front panel and back wall. The described fastening device requires very little space and secures the railing against tension and pressure loads.

Another advantage is that the swing-in direction of the front fastener proceeds level with the back wall fastener, so that both fasteners can be fixed with a swinging or swiveling motion.

Subsequently, several variation examples of the invention at hand shown by respective drawing figures are expounded on in more detail. Further characteristics, features and advantages of the invention follow from the drawings and their descriptions.

DETAILED DESCRIPTION OF THE INVENTION

Figure 1:
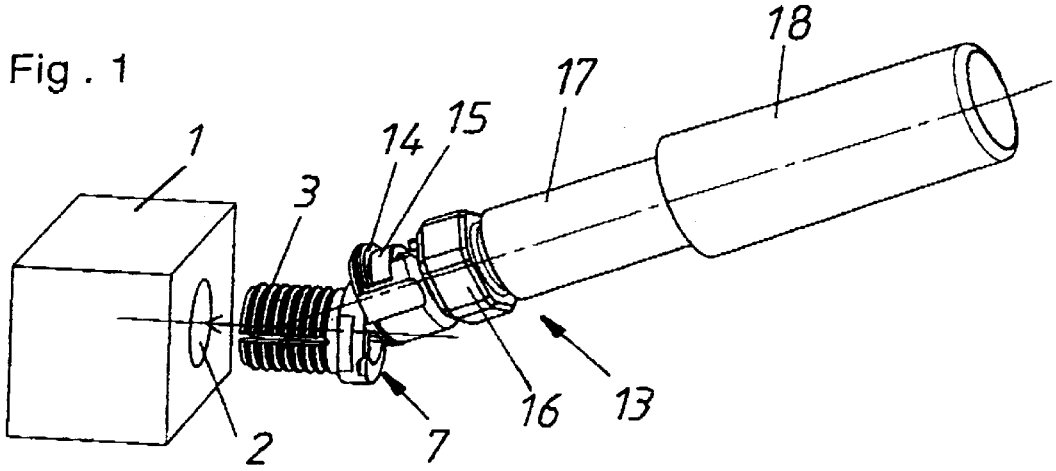
FIG. 1. A lateral, perspective view of the railing fastener.

A first embodiment of the railing fastener is represented in FIG. 1. One recognizes schematically a section of the front panel (1) of the drawer, which has a fastening bore hole (2) for an expansion dowel (3). The expansion dowel (3) is inserted before the assembly of the railing fastener in the fastener bore hole (2). The railing fastener, respectively the fastener fitting, consists of a head component (7), which is connected to the expansion dowel (3), as well as an intermediate piece, which carries a setting nut (16) to adjust the railing (17) lengthwise. The head component (7) and the intermediate piece (13) are connectable together by means of a coupling (14) and a corresponding coupling counterpart (15). A union sleeve (18) is located on the railing (17), and it (the union sleeve) can cover the entire system.

Figure 2:
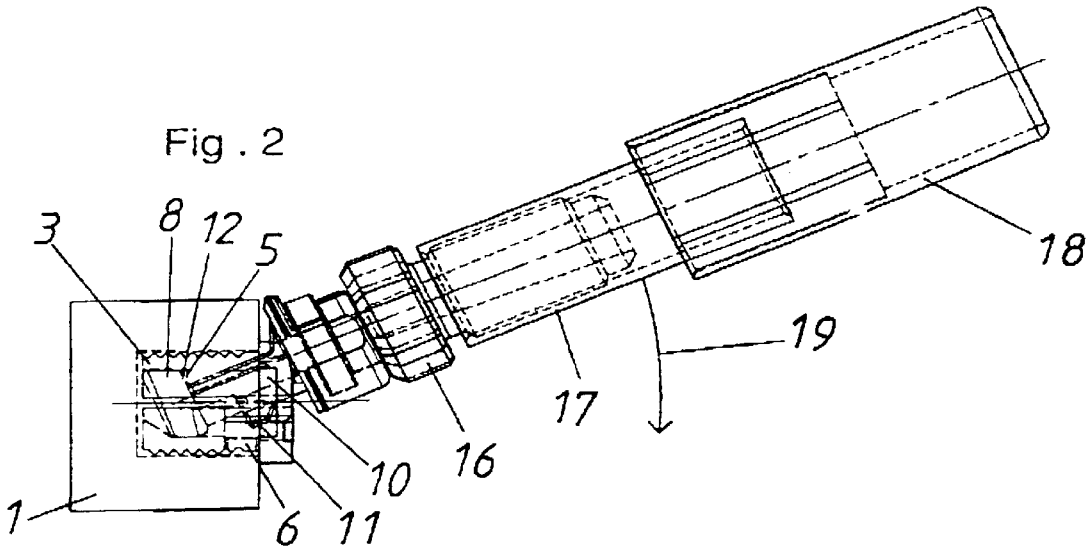
FIG. 2. A longitudinal section through the front panel and the railing fastener in the assembly stage.
Figure 3:
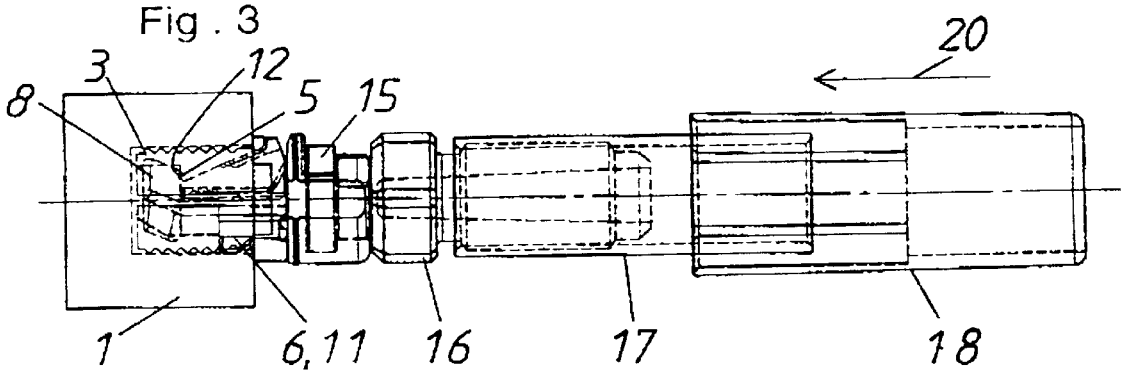
FIG. 3. A longitudinal section through the front panel and the railing fastener in the assembled state.

FIGS. 2 and 3 show the whole system in sections. The expansion dowel (3) fits into the fastening bore hole (2) of the front panel (1). The fastener fitting with its head component (7) and expansion head (8) are now guided in a slanted angle to the expansion dowel's (3) shaft (long axis) into the expansion dowel; the expansion dowel (3) has guide grooves (4) in which corresponding guide ribs of the expansion head (8) can be guided (compare FIGS. 8 and 9). The expansion head (8) is also inserted slanted into the expansion dowel (3) and pushed in until it hits; then the guide ribs (9) reach, beyond contact with the guide groove (4), and the entire fastener fitting can be swiveled in the arrow direction (19) so that it is located in an axis with the expansion dowel (3), as is evident in FIG. 3. Then one of the shoulders (11) on the expansion head (8) reaches a corresponding notch (6) of the expansion dowel (3) and functions there as counterbearing; the expansion head (8) presses from inside against the expansion dowel (3) and serves to anchor it in the fastening bore hole (2). The expansion dowel (3), furthermore, has an inwardly directed edge (5) on which a corresponding shoulder (12) of the expansion head (8) is placed. An axial sliding security occurs now, because in this position, the fastener fitting (respectively the expansion dowel [8]) can no longer be taken out of the expansion dowel (3).

Figure 4:
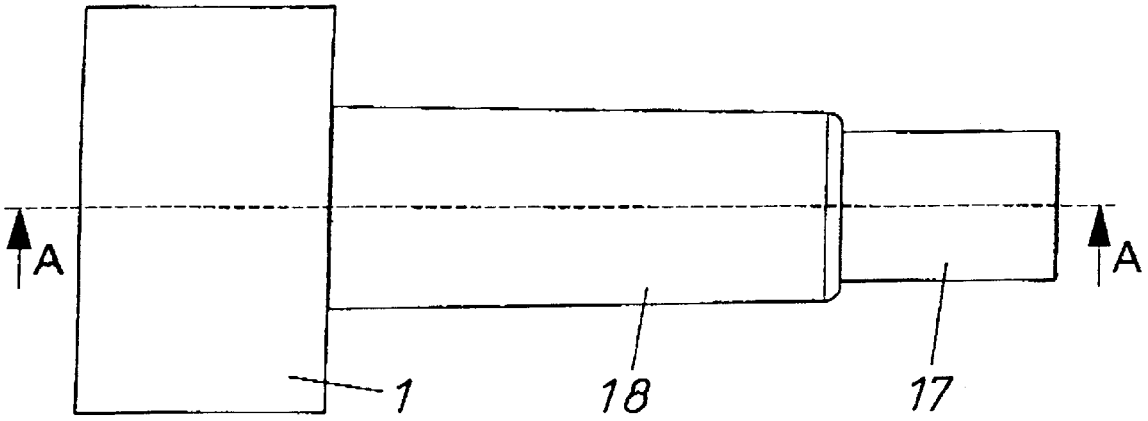
FIG. 4. A side view of the railing fastener with the union sleeve pushed up.

FIG. 4 shows a side view of the union sleeve (18) pushed over the system.

Figure 5:
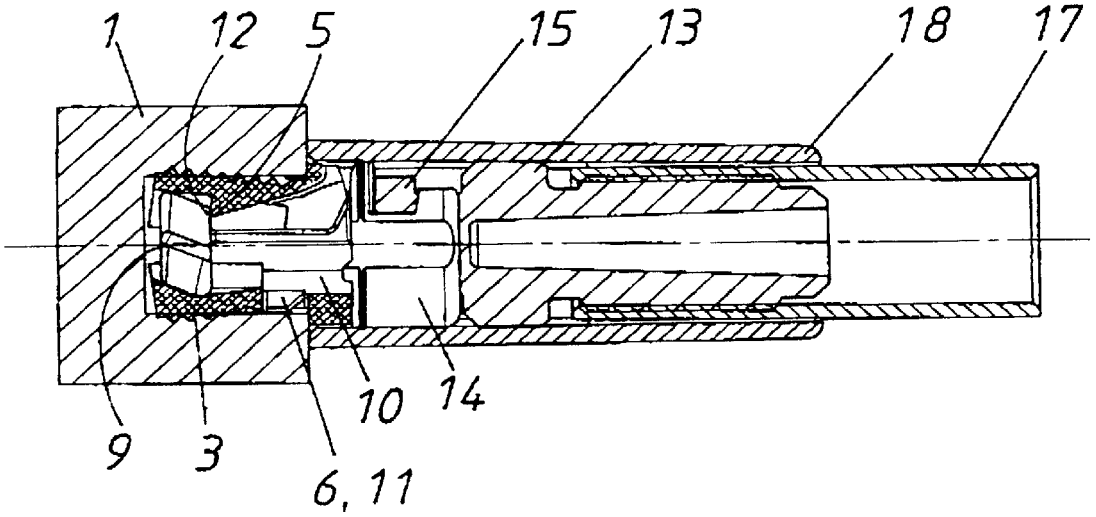
FIG. 5. A longitudinal section through the embodiment according to FIG. 4.

FIG. 5 shows a section of the representation in FIG. 4; here, one recognizes very well how the shoulder (11) of the lever piece (10) lies in the notch (6) of the expansion dowel (3) and how the shoulder (12) of the expansion head (8) fits on the corresponding edge (5) of the expansion dowel (3) so that the expansion head (8) can no longer be taken out of the expansion dowel (3). One also recognizes how the expansion dowel (3) spreads in the receptacle opening (2) and "digs in" with respective outer teeth into the front panel (1). The union sleeve (18) can cover and protect the whole system.

Figure 6:
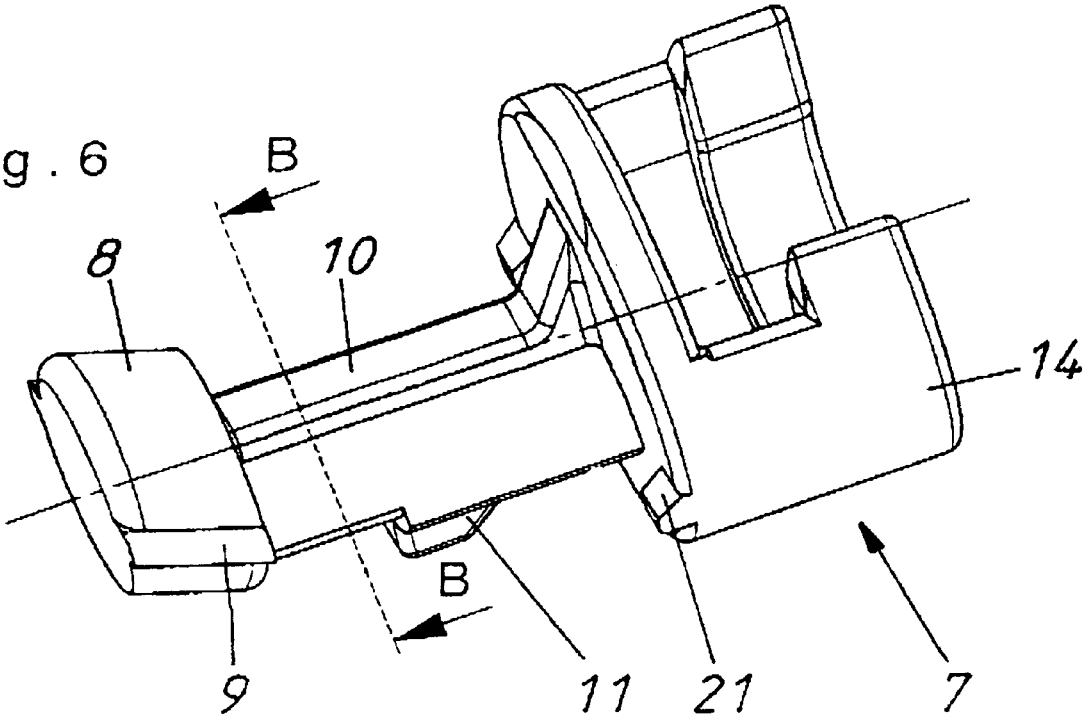
FIG. 6. A perspective view of the head component according to the first embodiment.
Figure 7:
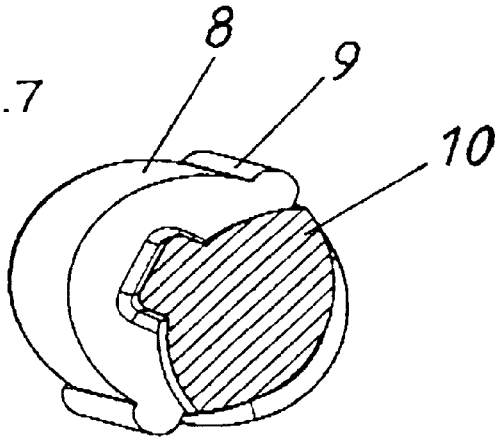
FIG. 7. A section through the head component along the line B—B in FIG. 6.

FIGS. 6 and 7 show the details of the head component (7). This includes a coupling (14), which enables it to be connected to an intermediate piece (13). A lever piece (10) is provided that carries the shoulder (11) that works as a counter pressure. At the front end of the lever piece an expansion head (8) is located with its guide ribs (9). The coupling (14) has, in the direction of the expansion head (9), two projections (21) located opposite to one another, whose function is described more closely below.

Figure 8:
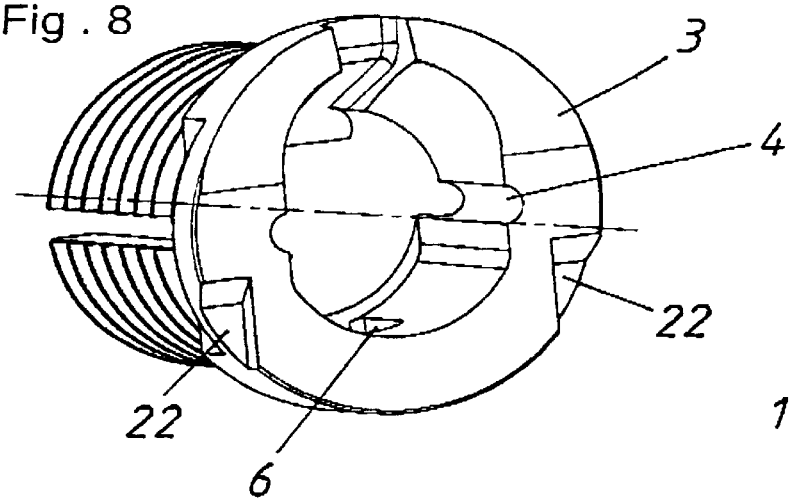
FIG. 8. A perspective view of the expansion dowel.

The design of the expansion dowel is represented in FIG. 8. One recognizes it in the wall of the insertion opening of the in wrought guide grooves (4) and the notch (6), which "receives" the shoulder (11) of the lever piece (10). Furthermore, one recognizes the two-part formation of the dowel end piece that makes an expansion or spreading by the corresponding inside-pressure possible. The catch teeth on the outer perimeter of the expansion dowel allow "this" to be anchored firmly in a corresponding fastening bore hole. At the front of the expansion dowel (3) are two notches (22), which are located opposite from one another, and in which the projections (21) of the coupling (14) engage. These are used for the alignment and locking safety of the connection.

Figure 9:
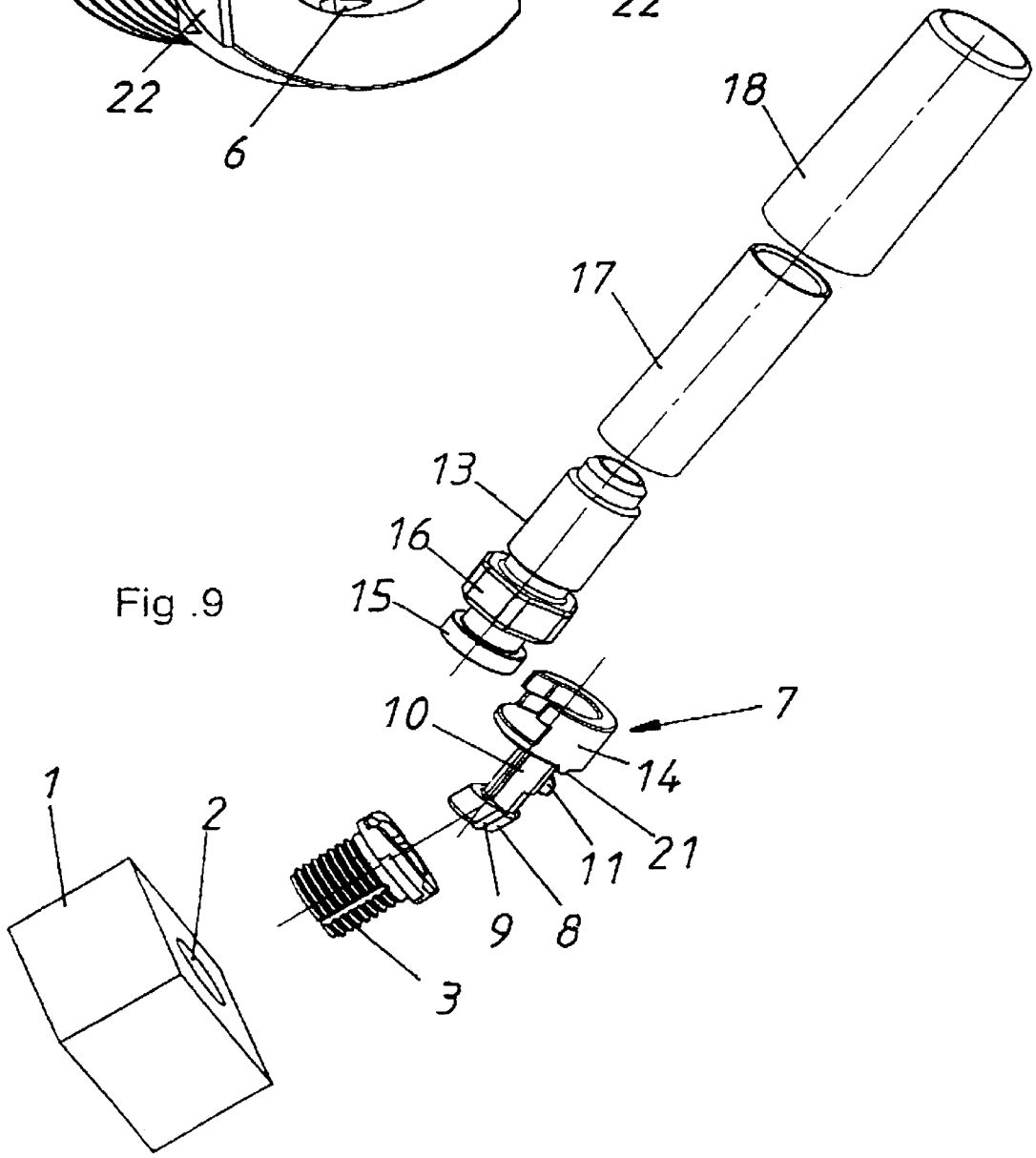
FIG. 9. An exploded view of the railing fastener according to FIGS. 1 through 8's described embodiments.

FIG. 9 shows an exploded representation of the railing fastener in the embodiment according to FIGS. 1 through 8.

FIGS. 10 to 14 now show another embodiment of a railing fastener, especially concerning the back fastening on the back wall of the drawer.

Figure 10:
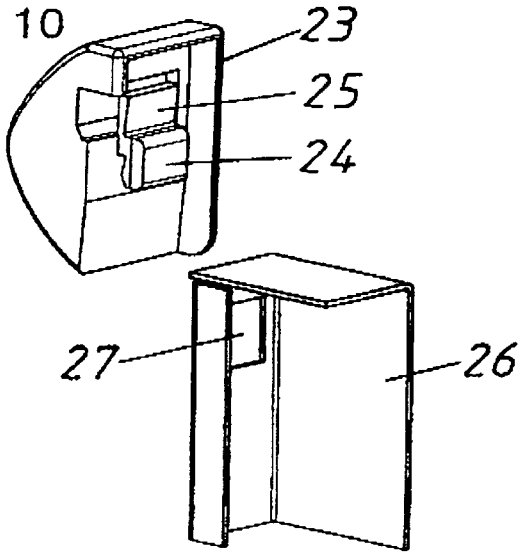
FIG. 10. A second embodiment of the railing fastener with the fastening component in perspective view and corresponding excerpt of the drawer back wall.

FIG. 10 show a section of the back wall (26), which has an opening (27) on the lateral edge. A fastening component (23) is provided with a hook extension (24), which can hang in the opening (27) so that the fastening component (23) is connected with the back wall (26). It can especially be recognized in FIG. 12 that the hook extension (24) is hanged in the back wall (26); an upper section of the fastening component (23) is placed on the corresponding section of the back wall (26). The fastening component has a detent pawl, which is directed opposite of the hook extension (24), whose dimensions are exactly sized to fill up the remaining part of the opening (27) with the inserted hook extension (24). The detent pawl (25) is formed as a springy tab and this prevents the fastening component (23) from being removed from the back wall (26) since this detent pawl (25) prevents the hook extension from coming out. The locking action of the detent pawl (25) can be lifted manually or with the corresponding tool; that is, the detent pawl can be pressed out from inside the drawer so that the fastening component (23) can be removed from the back wall.

Figure 11:
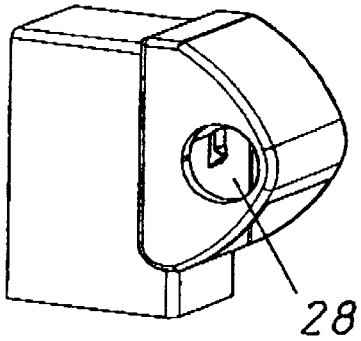
FIG. 11. A view of the fastener component fixed on the drawer back wall.
Figure 12:
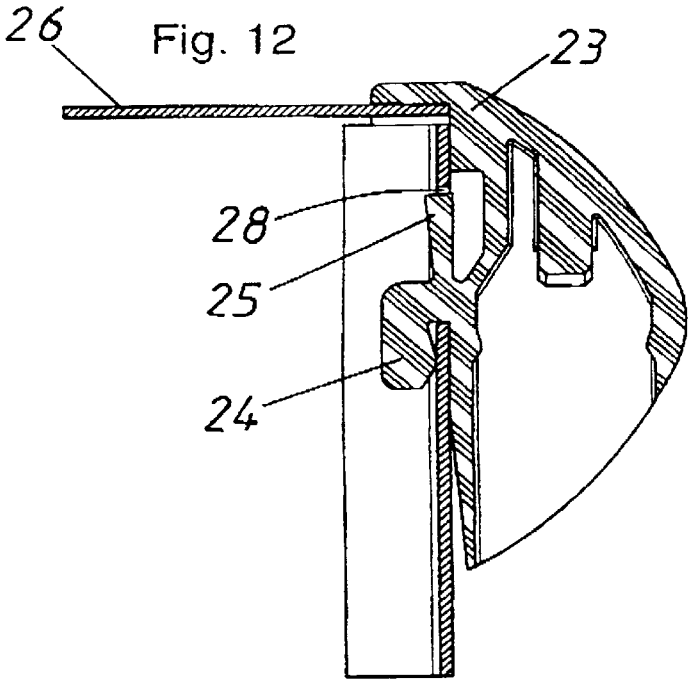
FIG. 12. A section through the fastening component fixed on the drawer back wall.
Figure 13:
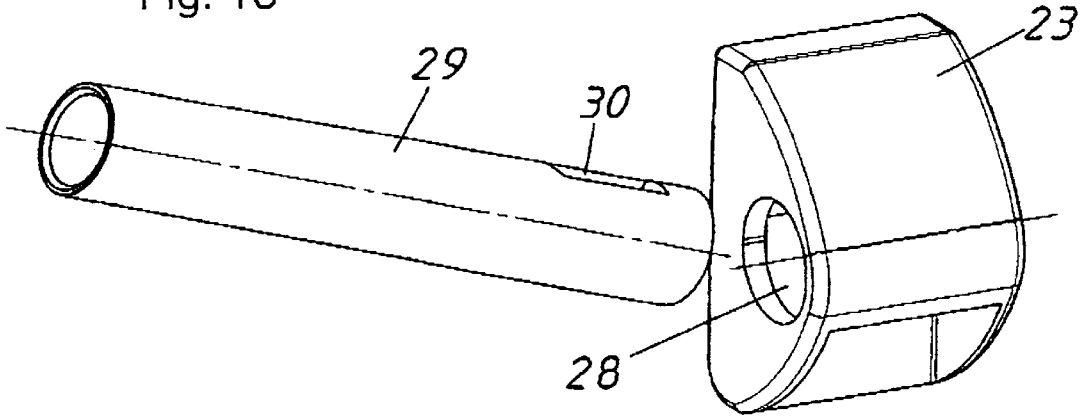
FIG. 13. A perspective view of the fastening component with the inserted railing pipe.
Figure 14:
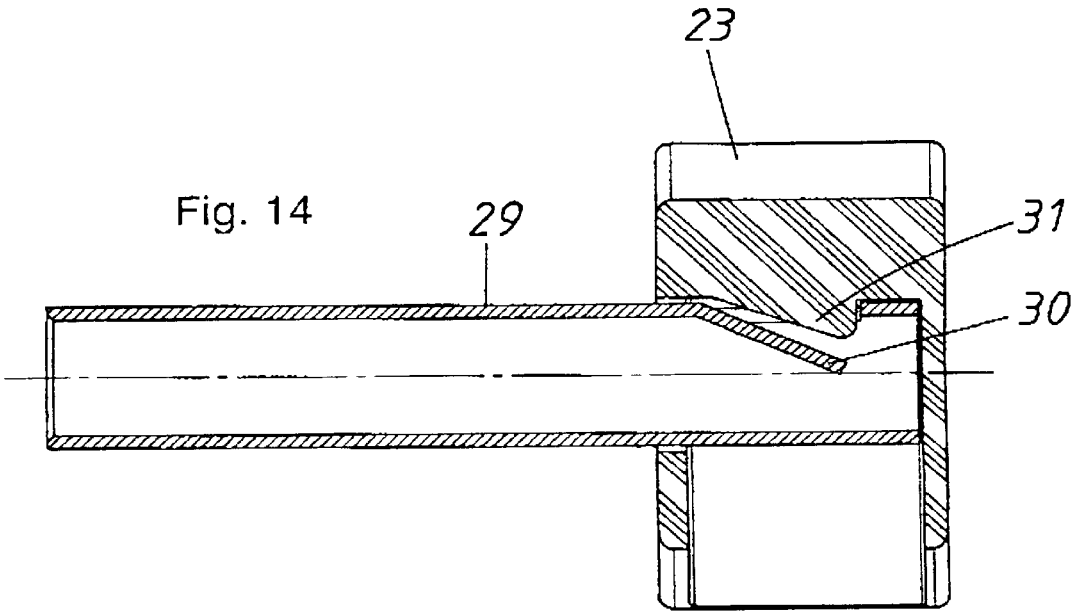
FIG. 14. A section through the fastening component with the inserted railing pipe.

FIGS. 11 and 13, especially, show the fastening component (23) that has a receptacle opening (28) for the railing pipe (29). The railing pipe (29) can be inserted into the receptacle opening (28) and locked into it. The railing pipe (29) proceeds over the tab (30), whose free end points in the direction of the railing pipe end. FIG. 14 shows a catch shoulder (31) that projects in the opening (28) of the fastening component (23); it (the catch shoulder) presses the tabs (30) radial and inward when the railing pipe (29) locks within the opening (28).

Figure 15:
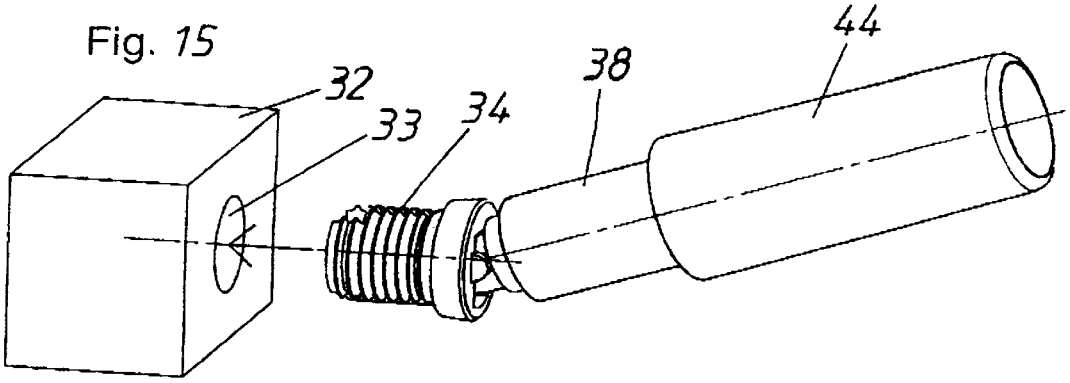
FIG. 15. A lateral perspective view of a third embodiment of the railing fastener.

A third embodiment of the railing fastener is shown in FIGS. 15 through 24. A section of the front panel (32) is represented in FIG. 15 in which an expansion dowel (34) can be inserted in a corresponding fastening bore hole (33) in the front panel. The railing pipe, itself, is connected to a head component (38), which can be anchored in the expansion dowel (34). The entire system can be covered with a union sleeve (44).

Figure 16:
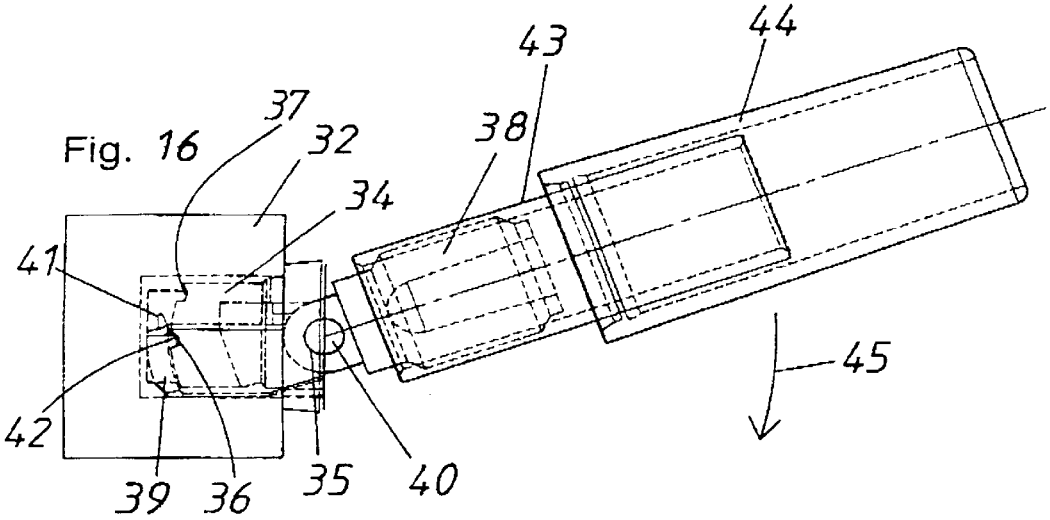
FIG. 16. A longitudinal section through the front panel and the railing fastener in the assembly stage.
Figure 17:
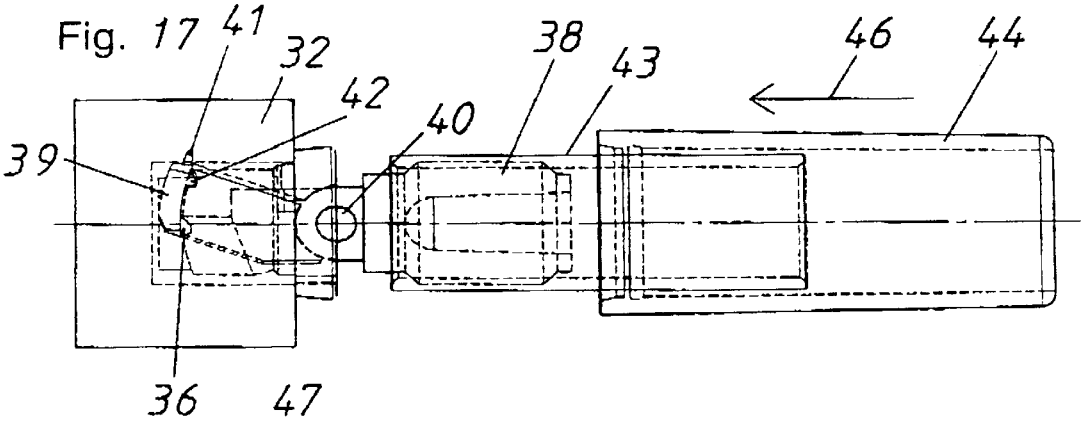
FIG. 17. A longitudinal section through the front panel and railing fastener in the completely assembled state.
Figure 18:
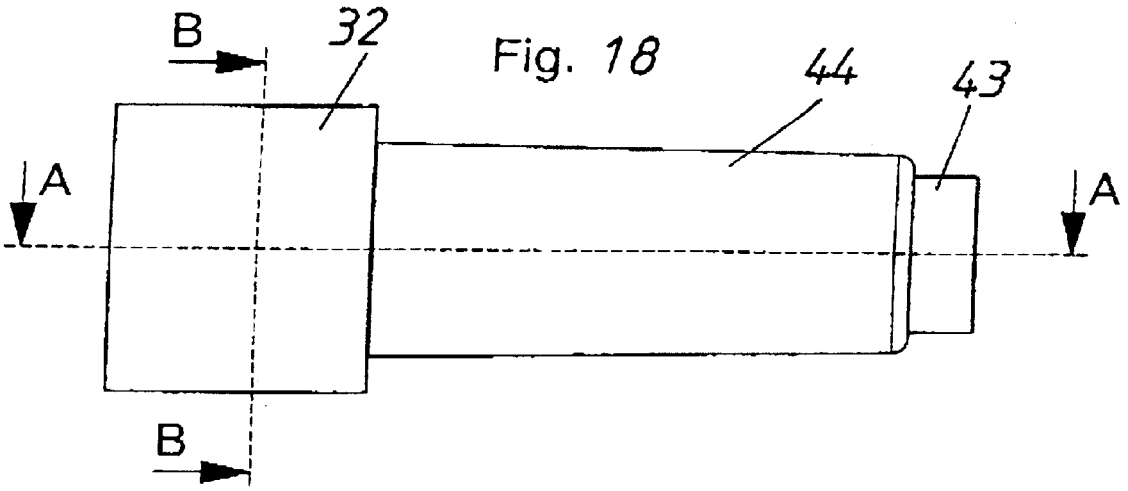
FIG. 18. A side view of railing fastener with union sleeve pushed up.
Figure 19:
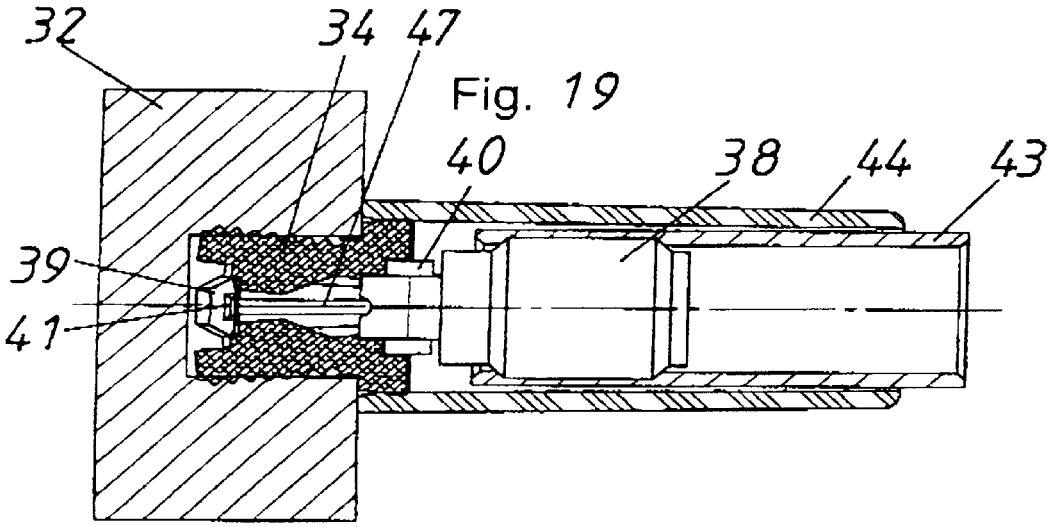
FIG. 19. A longitudinal section through the embodiment according to FIG. 18.
Figure 20:
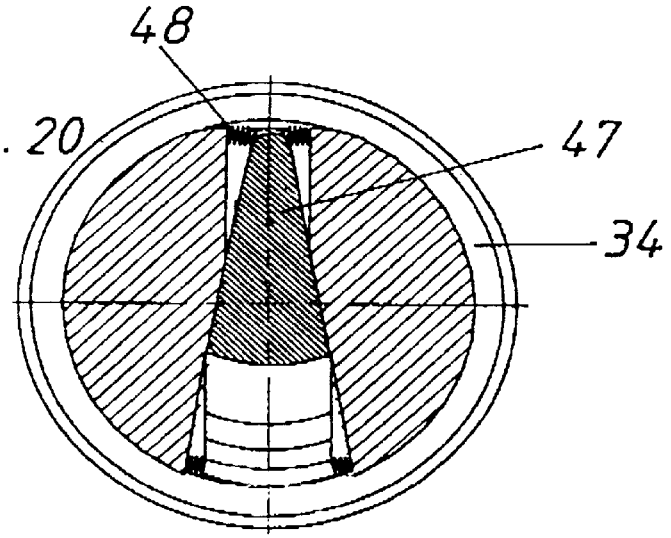
FIG. 20. A section through the expansion dowel with inserted expansion had according to Line B—B in FIG. 18.

FIG. 16 shows that, on the other hand, the fastening fitting is inserted at an angle to the shaft (lengthwise axis) of the expansion dowel (34). The head component (38) has two bearing shoulders (40) located opposite from each other, which come to lie in the corresponding bearing notches (35) of the expansion dowel (34), after the complete insertion of the head component (39). After the complete insertion of the expansion head (39) in the expansion dowel (34), corresponding catch shoulders (42) on the expansion head (39) reach respective catch notches (36) of the expansion dowel (34) in a first lock-in position. Now the fastener fitting can be swiveled or swung in the arrow direction (45) so that it forms a line with the shaft (lengthwise axis) of the expansion dowel (34). So the head component (38) is also swiveled along an axis defined by the bearing shoulders (40), so that the expansion head (39) is pressed on the inner wall of the fastening bore hole (33) and buries itself on a corresponding anchoring projection (41) on the expansion head (39) in the front panel's material. Simultaneously, the catch shoulder (42) of the expansion head (39) reaches a second lock-in position, which is defined by a second catch shoulder (37) in the expansion dowel (34). Through this second "catch" position and by the action and effect of the anchoring projection (41), the fastener fitting is secured against axial movement in the expansion dowel and is solidly secured in it. As shown, especially in FIGS. 19 and 20, the head component (38) has an expansion wedge (47), whose cross-section is formed somewhat V-shaped.

The push-in opening of the expansion dowel is fitted crosswise to this expansion wedge (47); it is wider at the lower part than the middle part and wider at the middle part than at the upper part. This makes it possible to insert the expansion head (39) with the expansion wedge (47) into the expansion dowel (34) so that after the expansion head (and with it, the expansion wedge [47]) is swiveled, it presses with its larger cross section against the inner walls of the expansion dowel (34) and there it expands and anchors firmly in the front panel (32). The expansion dowel (34) has on its outer perimeter a tooth system, which respectively buries itself into the material of the front panel.

Figure 21:
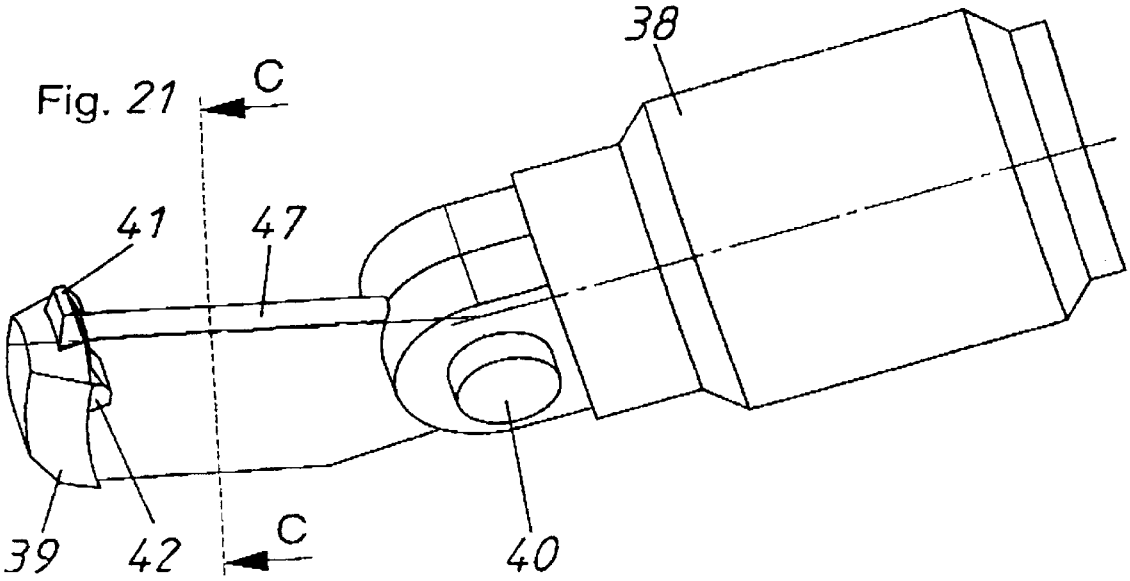
FIG. 21. A perspective view of the head component according to the first embodiment.
Figure 22:
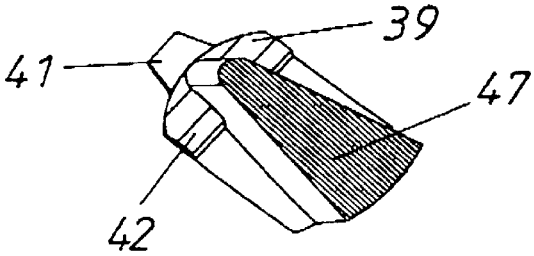
FIG. 22. A section through the head component along Line B—B in FIG. 21.

FIGS. 21 and 22 show the details of the head component (38). This includes an expansion wedge (47), which is connected to the expansion head (39). One can recognize the anchoring projection (41) arranged on the upper part of the expansion head very well, as well as the catch shoulders (42) that are located opposite to the insertion direction. The head component (39) has two oppositely placed bearing shoulders (40) to support the swinging motion. The bearing shoulders, which will be described in more detail below, engage in the corresponding bearing notches (35) of the expansion dowel (34). FIG. 22 clearly shows the wedge-shaped design of the expansion wedge (47).

Figure 23:
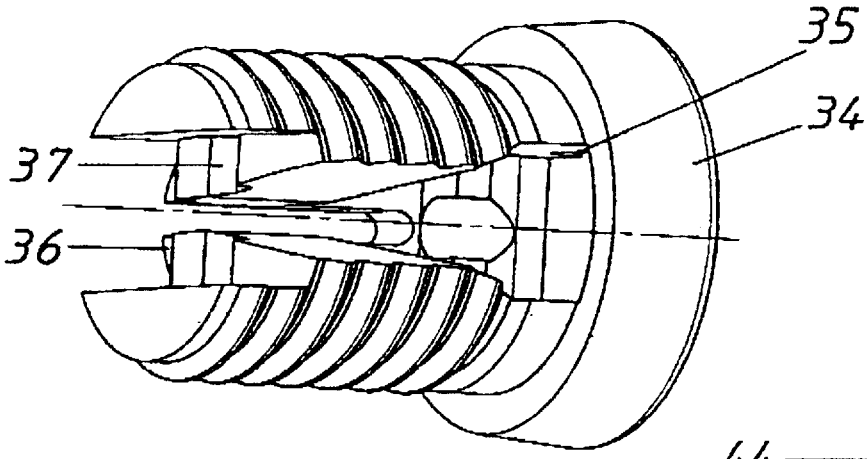
FIG. 23. A perspective view of the expansion dowel.

FIG. 23 shows the details of the expansion dowel (34). This has a somewhat wedge-shaped insertion opening, which is wider at the bottom than at the top. The insertion opening widens in the rear area so that the inserted expansion head (39) has room. Bearing notches (35) are placed in the area of the insertion opening where the bearing shoulders (40) of the head component (38) come to rest. The catch notches (36) are shown in the rear area; they engage, depending on the swinging movement, the corresponding catch shoulders (42) of the expansion head (39). They, in the catch shoulders (47) corresponding position of the expansion head (39), can no longer loosen axially from the expansion dowel (34).

Figure 24:
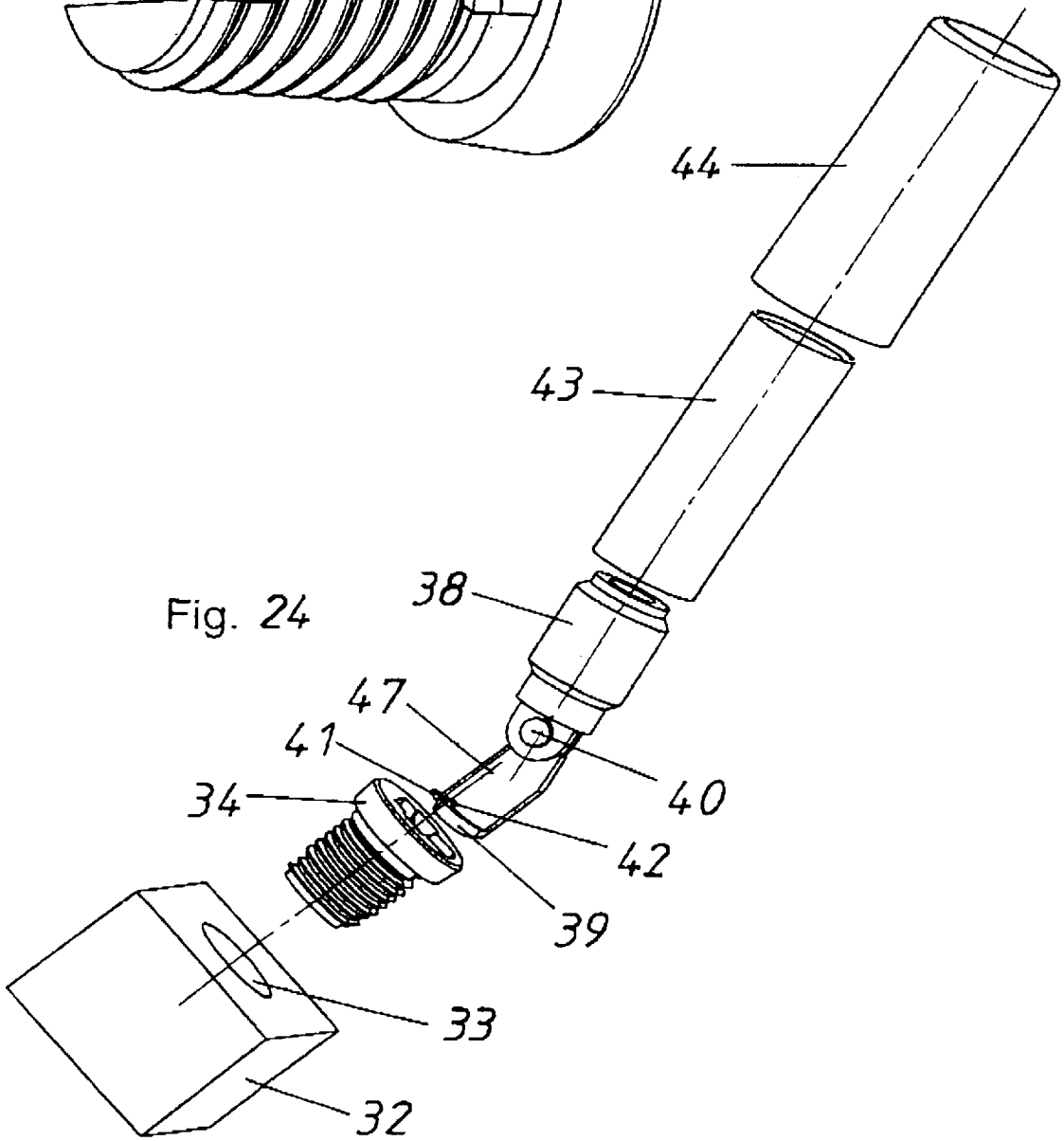
FIG. 24. An exploded view of the railing fastener according to the embodiments shown in FIGS. 15 through 23.

FIG. 24 shows, finally, an exploded representation of the embodiment, which is described in FIGS. 15 through 23.

Drawing Legend

1. Front panel
2. Fastening bore hole
3. Expansion dowel
4. Guide groove
5. Edge
6. Notch
7. Head component
8. Expansion head
9. Guide ribs
10. Lever piece
11. Shoulder
12. Shoulder
13. Intermediate piece
14. Coupling
15. Coupling counterpart
16. Setting nut
17. Railing pipe
18. Union sleeve
19. Arrow direction
20. Arrow direction
21. Projection
22. Notch
23. Fastening component
24. Hook extension
25. Detent pawl
26. Back panel
27. Opening

28. Opening
29. Railing pipe
30. Tab
31. Catch shoulder
32. Front panel
33. Fastening bore hole
34. Expansion dowel
35. Bearing notch
36. Catch notch
37. Catch shoulder
38. Head component
39. Expansion head
40. Bearing shoulder
41. Anchoring projection
42. Catch shoulder
43. Railing pipe
44. Union sleeve
45. Arrow direction
46. Arrow direction
47. Expansion wedge
48. Teeth

What is claimed is:

1. A railing fastener for connecting a railing pipe to a front panel of a drawer, the railing fastener comprising, an expansion dowel adapted to be inserted into the front panel of the drawer; and a fastener fitting adapted to be connected to the railing pipe, wherein the fastener fitting comprises a head component having an expansion head with guide ribs which correspond to guide grooves of the expansion dowel and which guide the insertion of the expansion head into the expansion dowel thereby spreading the expansion dowel, and wherein the guide ribs become disengaged from the guide grooves by swinging or swiveling of the fastener fitting upon complete insertion of the expansion head into the expansion dowel, thereby functioning to secure the insertion of the expansion head in the expansion dowel and preventing the expansion dowel from being withdrawn.

2. The railing fastener of claim 1, wherein the expansion head is attached to a lever piece comprising a shoulder, wherein the fastener fitting is adapted to be tipped thereby bringing the shoulder into engagement with an allocated notch of the expansion dowel, the shoulder acting as a counter pressure retainer for the fastener fitting in the expansion dowel.

3. The railing fastener of claim 1, wherein the guide grooves are located within a partial section of an elongated opening of the expansion dowel.

4. The railing fastener of claim 1, wherein the interior of the expansion dowel comprises an edge, the face of which is directed inward towards the direction of insertion of the expansion dowel into the front panel of the drawer, upon which a shoulder of the expansion head rests when inserted, thereby providing additional protection against axial extraction of the expansion head.

5. The railing fastener of claim 1, wherein the head component further comprises a coupling which is adapted to be connected to a corresponding intermediate piece.

6. The railing fastener of claim 5, wherein the intermediate piece is adapted to be connected to a railing pipe.

7. A railing fastener for connecting a railing pipe to a front panel of a drawer, the railing faster comprising, an expansion dowel adapted to be inserted into the front panel of the drawer; and a fastener fitting adapted to be connected to the railing pipe, wherein the fastener fitting comprises a head component having an expansion head adapted to be inserted into the expansion dowel, the expansion head comprising at least one catch shoulder on its rear end which engages a first lock-in position of at least one corresponding catch notch of the expansion dowel upon complete insertion of the expansion head into the expansion dowel, and the at least one catch shoulder also engages a second lock-in position of at least one corresponding catch notch of the expansion dowel by swinging or swiveling of the fastener fitting after complete insertion, thereby securing the expansion head from extraction from the expansion dowel.

8. The railing fastener according to claim 7, wherein the expansion head further comprises at least one anchoring projection which is directed radially outward.

9. The railing fastener according to claim 7, wherein the head component further comprises oppositely-located bearing shoulders which are directed radially outward, and which, after complete insertion of the expansion head, engage corresponding bearing notches of the expansion dowel so that the swinging of the head component results along an axis defined by the oppositely-located bearing shoulders.

10. The railing fastener according to claim 7, wherein the head component further comprises an expansion wedge.

11. The railing fastener according to claim 10, wherein the expansion dowel comprises a somewhat V-shaped elongated opening that fits the wedge-shaped cross section of the expansion wedge, such that when the head component is swiveled, the expansion wedge moves crosswise to the elongated opening and the expansion dowel is spread outwardly.

12. A railing fastener comprising a railing pipe and a fastening component for connecting the railing pipe to a back wall of a drawer, the fastening component comprising a hook extension having a detent pawl, wherein the hook extension allows the fastening component to be hanged in a corresponding opening of a back wall of the drawer; and wherein the detent pawl extends in the opposite direction from the hook extension within the opening and prevents the hook extension from coming out, thereby preventing the fastening component from loosening or coming undone from the back wall.

13. The railing fastener according to claim 12, wherein the detent pawl is formed from a resilient material, whereby the locking action thereof can be released manually or with a corresponding tool by pressing the detent pawl out of direct alignment with the edges of the opening.

14. The railing fastener according to claim 12, wherein the railing pipe is adapted to be inserted, and then locked, in a corresponding opening in the fastening connector.

15. The railing fastener according to claim 14, wherein the railing pipe comprises a tab formed from its outer perimeter, and wherein a free end of the tab points in the direction of the railing pipe end.

16. The railing fastener according to claim 15, wherein the fastening component further comprises a catch shoulder that projects into the opening of the fastening component, such that when the railing pipe is inserted, the tab is pressed radially inward allowing the catch shoulder to abut an edge of an opening in the outer perimeter of the railing pipe, thereby securing the railing pipe within the opening.

* * * * *